US010060224B2

(12) United States Patent
Cortez et al.

(10) Patent No.: US 10,060,224 B2
(45) Date of Patent: Aug. 28, 2018

(54) LINER TOP POROUS DEBRIS BARRIER

(71) Applicant: BAKER HUGHES INCORPORATED, Houston, TX (US)

(72) Inventors: Steve M. Cortez, Katy, TX (US); Jack D. Farmer, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 342 days.

(21) Appl. No.: 14/683,357

(22) Filed: Apr. 10, 2015

(65) Prior Publication Data

US 2016/0298428 A1 Oct. 13, 2016

(51) Int. Cl.
*E21B 43/08* (2006.01)
*E21B 41/00* (2006.01)

(52) U.S. Cl.
CPC ..... *E21B 41/0021* (2013.01)

(58) Field of Classification Search
CPC ..... E21B 37/02; E21B 37/10; E21B 43/38; E21B 33/136; E21B 41/0021
See application file for complete search history.

(56) References Cited

U.S. PATENT DOCUMENTS 3,102,600 A * 9/1963 Jackson ..... E21B 21/12 175/215
5,570,742 A * 11/1996 Reynolds ..... E21B 37/02 15/104.16
6,896,049 B2 5/2005 Moyes
7,604,048 B2 10/2009 Kossa et al.
7,905,280 B2 3/2011 Mills
8,464,787 B2 6/2013 O'Malley
8,631,863 B2 1/2014 Heckel et al.
8,794,313 B2 8/2014 Heckel et al.
8,881,802 B2 11/2014 Gorman
2010/0288492 A1 11/2010 Blackman et al.
2013/0032342 A1 * 2/2013 Hager ..... E21B 43/128 166/276

* cited by examiner

*Primary Examiner* — Cathleen R Hutchins
*Assistant Examiner* — Brandon M Duck
(74) *Attorney, Agent, or Firm* — Steve Rosenblatt

(57) ABSTRACT

An annular space is made smaller with a hub on an inner member that supports a base ring from which extend bristles that are preferably wire whose proximity is close enough to retain debris from passing through while leaving sufficient fluid paths to allow fluid movement in opposed directions in response to relative axial movement of the components that define the annular space. In one application a running tool for a liner string that has a hanger/packer is contemplated. Movement of the running string after the hanger is set and the liner is released from the string keeps the barrier in the annular space while allowing movement of an initially inserted gel put there on assembly to migrate from the annular space through the debris barrier. The running tool can have a cap on the liner top that eventually is moved away as the running tool is picked up.

18 Claims, 3 Drawing Sheets

LINER TOP POROUS DEBRIS BARRIER

FIELD OF THE INVENTION

The field of the invention is a debris barrier and more particularly a barrier for a liner top that can hold back debris while allowing fluid to migrate in opposed directions.

BACKGROUND OF THE INVENTION

Frequently in downhole equipment there are narrow annular spaces that can be exposed to well fluids that have a fair amount of debris. The debris can get into small spaces and stick equipment which can have the negative result of keeping components from moving relatively when needed for either setting tools or releasing tools.

Various designs for debris barriers have been proposed. Some involve components that fold on each other to span an annular space and close it off. These designs can act similar to seals and this can create other issues such as liquid locking of relatively moving parts if fluid in volumes that are made smaller has no escape route or conversely with volumes that are made larger there being no way for fluid to enter hence the liquid locking problem. Some folding debris barrier design are U.S. Pat. No. 6,896,049 and U.S. Pat. No. 7,604,048. One solution to the liquid locking problem is to provide a bypass with a rupture disc as shown in U.S. Pat. No. 8,881,802. Other designs simply fill an irregular space with foam to keep debris out of dead end spaces that are not annularly shaped. U.S. Pat. No. 8,464,787 shows odd space filling and annular members that are stated to stop debris while allowing pressure to dissipate across the barrier. This design that uses foam is for generally light debris applications as the foam lacks structural integrity when large debris loads land on a barrier made from that material. What can then happen is compaction to the point where the porous member can become impervious thereby bringing up the liquid locking problem described above. Additionally, closed-cell foams and open-cell foams that have lost their permeability may trap compressible liquids or gases, leading to a decrease in volume under pressure. This can prevent the foam from acting as an adequate barrier. Other designs, such as US 2010/0288492, add complexity to the debris barrier design with sensors to detect blocking that can alert surface personnel to stop pumps or to reverse flow direction to clear the barrier. These solutions are not always practical in limited space environment where a simple structure is needed to perform the desired function without taking up a lot of space. Other designs feature a loose fitting ring member to fill an annular space with opposed grooves to trap what solids migrate into the clearance space. This design is effective for some applications but in heavy debris environments the debris can clog the grooves and even put the rings askew to let pass an undesired amount of solids. Such designs are shown in U.S. Pat. No. 8,631,863 and U.S. Pat. No. 8,794,313. Finally there are cup shaped seals with backup rings that can be impervious which leads to the potential of liquid locking depending on the direction of relative movement. Even when alternative materials are used, as suggested by this reference, there can still be problems when there is relative movement that can contort the cup shape or mar one of the opposing surfaces that define an annular gap. U.S. Pat. No. 7,905,280 mentions the use of a metal wire brush material in the context of an actuated seal that has a cup shape in a context where there is no relative movement between the parts.

The present invention provides a simple design for an annular gap between downhole components that may be filled with gel or clean fluid as one avenue of eliminating the incursion of debris. However, the relative movement between a running string and a surrounding liner top having an external hanger/packer can urge the gel or clean fluid to move as volumes decrease so that the barrier needs to be porous and/or flexible enough to let a gel pass while at the same time it needs to keep out the debris and have enough structural rigidity to support the debris if there are large accumulations without experiencing a structural collapse from loading. These and other features of the present invention will be more readily apparent to those skilled in the art from a review of the preferred embodiment and the associated drawings while recognizing that the full scope of the invention is to be found in the appended claims.

SUMMARY OF THE INVENTION

An annular space is made smaller with a hub on an inner member that supports a base ring from which extend bristles that are preferably wire whose proximity is close enough to retain debris from passing through while leaving sufficient fluid paths to allow fluid movement in opposed directions in response to relative axial movement of the components that define the annular space. In one application a running tool for a liner string that has a hanger/packer is contemplated. Movement of the running string after the hanger is set and the liner is released from the string keeps the barrier in the annular space while allowing movement of an initially inserted gel or clean fluid put there on assembly to migrate from the annular space through the debris barrier. The running tool can have a cap on the liner top that eventually is moved away as the running tool is picked up.

DETAILED DESCRIPTION OF THE PREFERRED EMBODIMENT

Figure 1A:
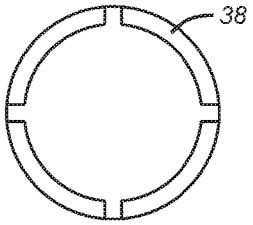
FIG. 1*a* is a section view in the direction of line 1*a*-1*a* of FIG. 1 showing the abutting ring segments.
Figure 1:
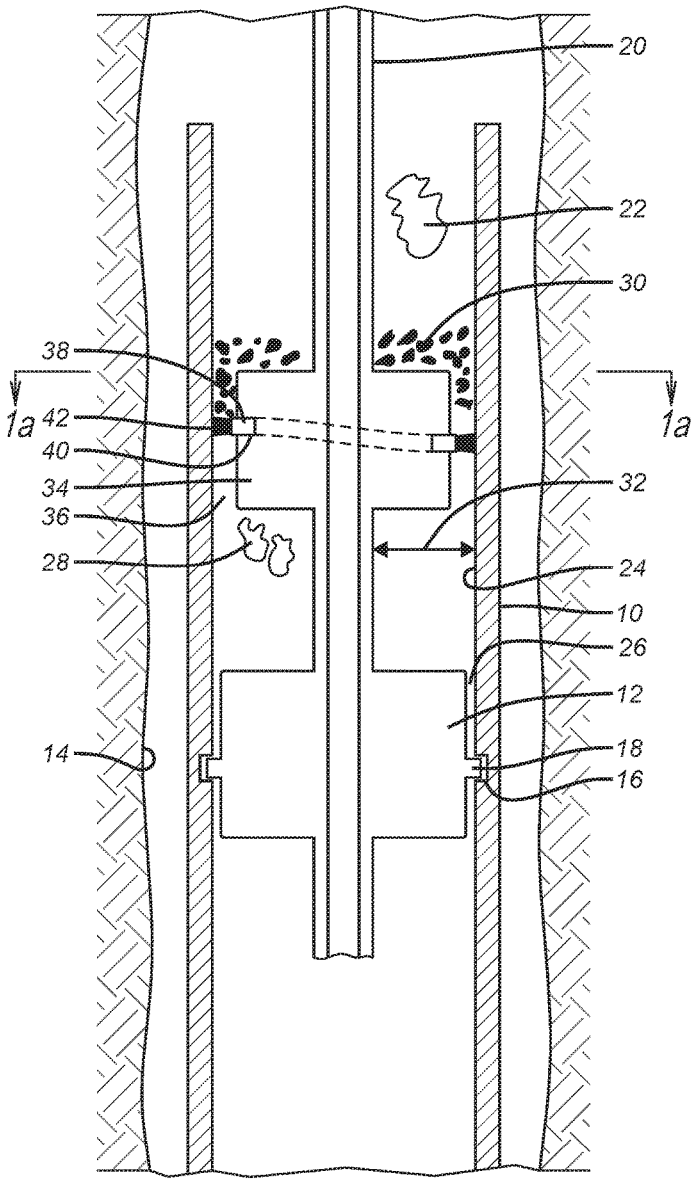
FIG. 1 is a section view of a debris barrier for an annular space where there is no top cap.

Referring to FIG. 1 a liner top extension 10 is illustrated being held up by a schematically illustrated running tool of a known design. The location is in a borehole schematically illustrated as 14. The extension 10 has grooves 16 into which dogs 18 are made to selectively extend. Further below the extension 10 but not shown are a liner hanger and an associated packer also of a known design. Typically the hanger is set to support the liner and associated extension 10 to an existing tubular that surrounds them in the borehole 14. After the hanger that is not shown is actuated, the dogs 18 are allowed to retract from the associated groove 16 so that the running string 20 can be manipulated axially relatively to the now supported extension 10 due to the setting of the liner hanger that is not shown. Surface personnel will usually pick up the running string a predetermined distance to make sure that there is a release from the extension 10 by the running tool 12. After that a cementing operation will take place followed by a setting of the liner top packer and then removal of the running string 20 with the running tool 12.

The environment around the connection between the running tool 12 and the liner extension 10 is shown in FIG. 1 as exposed to well fluids schematically illustrated as 22. Well fluids 22 carry debris of all types some of which can settle on the running tool 12 and prevent the dogs 18 from releasing from the grooves 16. Alternatively, the accumulated debris can simply jam the running tool 12 to the inside wall 24 of the liner extension 10. Debris barriers in the past have been designed to keep the gap 26 free of debris. One attempt to do that in the past has been to simply fill the annular volume between the running string 20 and the extension 10 with a gel material 28 with the idea being that the debris will be captured by the gel material 28 before reaching the gap 26. Conceptually this sounded reasonable except that the gel material 28 if not contained would be displaced due to relative movement between the string 20 and the extension 10 after the liner hanger (not shown) was set and the running tool 12 was released from the extension as described above.

The need arose for a way to keep the gel material 28 reasonably contained while at the fairly small in the radial direction and thus could jam the running tool 12 without a large accumulation, the radial space indicated by arrow 32 was quite larger. Accordingly, the present invention adds a hub 34 to create a second gap 36 around the hub 34 that is defined by the surrounding extension 10. The second gap 36 is sized so that a base ring 38 can fit into a circular groove 40. The ring 38 can be one piece if the hub 34 is made of connectible components that define the groove 40 over the mounted ring 38. On the other hand, ring 38 can be in abutting segments that can be connected to each other inside the groove 40 or alternatively individually connected to the hub 34 while positioned in groove 40.

The ring 38 whether made in one piece or segments has radially extending closely spaced elongated members or bristles 42 that extend across second gap 36 and preferably contact inside wall 24 with at least a clearance fit although an interference fit is preferred. For structural rigidity to support debris 30 on the uphole side as shown in FIG. 1 it is preferred that the bristles be of a material compatible with well temperatures and chemical conditions with metals such as steel, titanium or other reasonably flexible materials be used. The reason is that the bristles 42 will need to flex in one direction for assembly and in the opposite direction for removal of the running tool 12. The bristles 42 can be continuous in a single row for 360 degrees or can be in multiple rows for 360 degrees. In another alternative a spiral winding making at least one revolution but preferably more than one revolution can be used to ensure debris is excluded from gap 26. The bristles 42 while being strong enough to support the accumulated debris 30 and take the debris 30 out of the extension 10 as the running string 20 pulls out the running tool 12 also have the feature that when in service they can let some of the gel material 28 get past them in an uphole direction so that the running tool 12 does not get liquid locked in either direction. In other words, the bristles 42 span the second gap 36 created with hub 34 while having a porous feature to prevent liquid lock while at the same time having the structural rigidity to support the accumulated debris 30 while being strong enough to forcibly move the debris 30 uphole if the debris 30 bridges together or cakes up into a cohesive solid so that the ring of the debris 30 can be broken free to allow removal of the running string 20 and the running tool 12 without having to employ disconnects that release and a subsequent trip in the hole to fish out a stuck running tool 12. Ideally the bristle wires can be ⅛ inch or smaller and their density should be such that the particles that are larger than No. 18 mesh (1 mm) get retained on top of the bristles 42.

Figure 2:
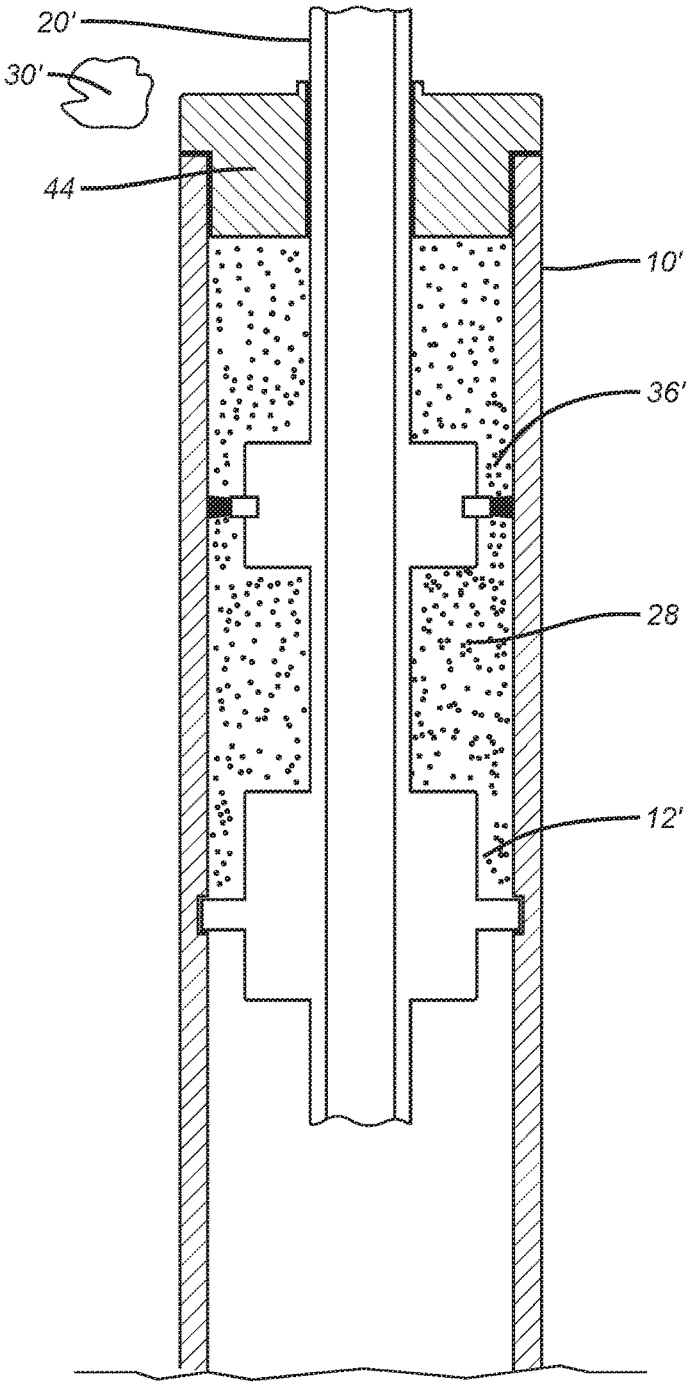
FIG. 2 is a section view of a debris barrier with a top cap before pipe manipulation.
Figure 3:
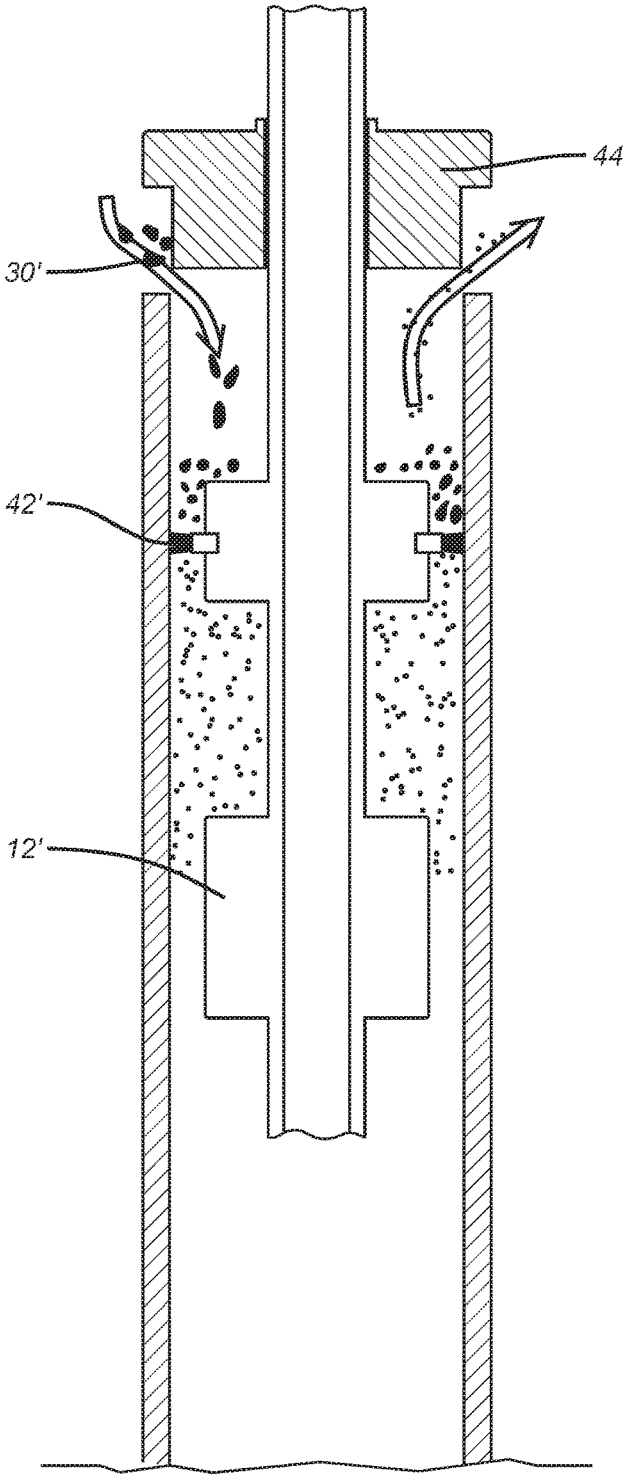
FIG. 3 is the view of FIG. 2 after pipe manipulation.

FIGS. 2 and 3 are essentially the same design as FIG. 1 with the addition of a debris cap 44 fixed to the running string 20. FIG. 2 illustrates running in before manipulation of the running string 20'. The cap 44 keeps out the debris 30' while the bristles 42' allow some of the gel material 28' to migrate to above the bristles 42'. Normally this migration will be minimal until relative movement of the string 20' relative to the extension 10' gets started. In FIG. 2 the running tool 12' is latched to the extension 10' in the manner described for FIG. 1. In FIG. 3, the running tool 12' has released from the extension 10' and the running string 20' has been picked up taking with it cap 44. Debris 30' can now enter as shown in FIG. 3 while the gel material that may have some buoyancy can migrate through the bristles 42' to avoid liquid locking of the running string 20'.

Those skilled in the art will appreciate that while an application for stopping debris in between a running string and a liner extension is discussed, the debris barrier can be used in other applications to exclude debris while permitting fluid flow to avoid liquid lock between the components. The bristles are strong enough to exclude solids above a predetermined mesh size but can also break up the caked debris without structural flexing or failure. Fluids can migrate in opposed directions to accommodate relative axial movement between the components that identify the annular space that is spanned by the bristles. The second gap 36 or 36' can be configured for a desired radial annular dimension to optimize the bristle length for flexibility to bend in response to relative axial relative movement of the components that define the space in which the bristles operate. At the same time the bristles need to be short enough to remain rigid to break up agglomerations of debris. The hub can be configured to obtain the desired bristle length range with the preferred range depending on the annulus diameter being less than 5 cm extension of the bristles from an outer surface of the hub. The bristles can be metallic or plastic or a composite or other materials that are compatible with well conditions while meeting the structural requirements of being able to flex for allowing component relative movement while avoiding undue bending or even collapse should the debris form into a solid mass that resists such normal component relative movement.

The above description is illustrative of the preferred embodiment and many modifications may be made by those skilled in the art without departing from the invention whose scope is to be determined from the literal and equivalent scope of the claims below:

We claim:

1. A debris barrier assembly for an annular gap between longitudinally relatively movable members, comprising:

a first and second nested members defining an annular space between, said first and second members releasably attached at a first narrow portion of said annular space, said annular space further comprising a second narrow portion spaced above from said first narrow portion to define a wider portion in between, said wider portion further containing a material in a well where said nested members are located, when said first and second nested members are attached, said material configured to entrain debris, said members selectively longitudinally relatively movable after release at said first narrow portion;

a debris barrier supported by one of said first and second members and spanning said second narrow portion, said barrier movable during said relative movement between said nested members while substantially containing said material within said wider portion and collecting debris thereon above said second narrow portion and;

said debris barrier comprises a plurality of elongated members closely mounted to retain debris above said second narrow portion in excess of a predetermined size and to allow said material to move through said elongated members in opposed directions to prevent liquid lock that would otherwise inhibit said relative movement between said nested members while retaining said material substantially in said wider portion for retention of debris that passes said elongated members.

2. The assembly of claim 1, wherein:

said elongated members because of their location in said second narrow portion are stiff enough to move debris collected above said second narrow portion out of a borehole upon removal of one said first or second members.

3. The assembly of claim 1, wherein:

said elongated members flex in opposed directions during said relative movement.

4. The assembly of claim 1, wherein:

said elongated members hold back debris larger than No. 18 mesh (1 mm).

5. The assembly of claim 1, wherein:

said elongated members comprise bristles that extend for at least 360 degrees in said annular space.

6. The assembly of claim 5, wherein:

said bristles are disposed in at least one row.

7. The assembly of claim 5, wherein:

said bristles are wound spirally for at least 360 degrees.

8. The assembly of claim 1, wherein:

said elongated members are made of metal, plastic or a composite material.

9. The assembly of claim 1, wherein:

said nested members comprise a running string with a running tool and a surrounding liner top extension.

10. The assembly of claim 9, wherein:

said elongated members are mounted to at least one ring secured to at least one groove on said running string.

11. The assembly of claim 10, wherein:

said elongated members comprise bristles that are metallic, plastic or a composite material.

12. The assembly of claim 10, wherein:

said material comprises a gel material or clean fluid that migrates in opposed directions through said elongated members depending of the direction of said relative movement.

13. The assembly of claim 10, wherein:

said ring is a continuous member for 360 degrees.

14. The assembly of claim 10, wherein:

said ring is in abutting segments secured to said at least one groove.

15. The assembly of claim 10, wherein:

said ring is spirally shaped and extends for at least 360 degrees.

16. The assembly of claim 10, wherein:

said ring supports said bristles against collapse during said relative movement so that debris moves in tandem with said bristles for removal from said annular space when said running sting is pulled out of the hole.

17. The assembly of claim 10, wherein:

said bristles extend less than 5 cm.

18. The assembly of claim 9, wherein:

said annular space is initially capped with a cap mounted to said running string that engages said liner top extension until said relative movement separates said cap from said liner top extension.

* * * * *